US007931180B2

(12) United States Patent
Lai

(10) Patent No.: US 7,931,180 B2
(45) Date of Patent: Apr. 26, 2011

(54) PNEUMATIC NAIL GUN

(75) Inventor: Chun-Chih Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 12/753,114

(22) Filed: Apr. 2, 2010

(65) Prior Publication Data

US 2010/0252608 A1 Oct. 7, 2010

(30) Foreign Application Priority Data

Apr. 3, 2009 (TW) ..... 98111237 A

(51) Int. Cl.
*B25C 1/04* (2006.01)

(52) U.S. Cl. ..... 227/8; 227/130

(58) Field of Classification Search ..... 227/8, 130, 227/156; 123/46 SC
See application file for complete search history.

(56) References Cited

U.S. PATENT DOCUMENTS

| | | | | |
|---|---|---|---|---|
| 3,563,438 | A * | 2/1971 | Doyle et al. | 227/8 |
| 3,583,496 | A * | 6/1971 | Fehrs | 173/15 |
| 4,550,643 | A * | 11/1985 | Schwartzenberger | 91/356 |
| 4,915,013 | A * | 4/1990 | Moraht et al. | 91/307 |
| 5,174,485 | A * | 12/1992 | Meyer | 227/8 |
| 5,522,532 | A * | 6/1996 | Chen | 227/8 |
| 5,669,542 | A * | 9/1997 | White | 227/8 |
| 5,671,880 | A * | 9/1997 | Ronconi | 227/130 |
| 5,785,228 | A * | 7/1998 | Fa et al. | 227/8 |
| 5,896,933 | A * | 4/1999 | White | 227/130 |
| 6,371,348 | B1 * | 4/2002 | Canlas et al. | 227/8 |
| 6,675,999 | B2 | 1/2004 | Mukoyama et al. | |
| 7,308,995 | B2 * | 12/2007 | Uchiyama et al. | 227/8 |
| 2007/0075113 | A1 | 4/2007 | Tillinghast et al. | |
| 2010/0012700 | A1 | 1/2010 | Perron et al. | |

FOREIGN PATENT DOCUMENTS

| | | |
|---|---|---|
| TW | 97119666 | 5/2008 |
| TW | 97121166 | 6/2008 |

* cited by examiner

*Primary Examiner* — Scott A. Smith
(74) *Attorney, Agent, or Firm* — CKC & Partners Co., Ltd.

(57) ABSTRACT

A pneumatic nail gun includes a gun body, a connecting mechanism, an acting valve, a trigger, a safety valve, and a trigger valve. The gun body includes a safety compressed air inlet and a firing compressed air inlet. The connecting mechanism is slidably disposed on the gun body. The acting valve is connected to the connecting mechanism. The trigger is connected to the gun body. The safety valve is connected to the acting valve for allowing a safety compressed air coming from the compressed air source to drive the acting valve to move the connecting mechanism forwards when the trigger is pulled. The trigger valve releases a firing compressed air coming from the compressed air source to project at least one nail only when the trigger is pulled, a workpiece blocks the connecting mechanism, and the trigger opens the trigger valve.

5 Claims, 4 Drawing Sheets

PNEUMATIC NAIL GUN

RELATED APPLICATIONS

The application claims priority to Taiwan Application Serial Number 98111237, filed Apr. 3, 2009, which is herein incorporated by reference.

BACKGROUND

1. Technical Field

The present disclosure relates to nail guns. More particularly, the present disclosure relates to pneumatic nail guns.

2. Description of Related Art

A power tool is a tool powered by an electric motor, a compressed air motor, an internal combustion engine, or even natural power inlets like wind or moving water. Power tools are classified as either stationary or portable, where portable means handheld.

The nail gun is a type of portable power tool used to drive nails into wood or some other kind of material. It is usually driven by electromagnetism, compressed air (pneumatic), highly flammable gases such as butane or propane, or, for powder-actuated tools, a small explosive charge.

SUMMARY

According to one embodiment of the present disclosure, a pneumatic nail gun includes a gun body, a connecting mechanism, an acting valve, a trigger, a safety valve, and a trigger valve. The gun body includes a safety compressed air inlet and a firing compressed air inlet for connecting to a compressed air source respectively. The connecting mechanism is slidably disposed on the gun body. The acting valve is connected to the connecting mechanism. The trigger is connected to the gun body. The safety valve is connected to the acting valve for allowing a safety compressed air coming from the compressed air source to drive the acting valve to move the connecting mechanism forwards when the trigger is pulled. The trigger valve releases a firing compressed air coming from the compressed air source to project at least one nail only when the trigger is pulled, a workpiece blocks the connecting mechanism, and the trigger opens the trigger valve.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
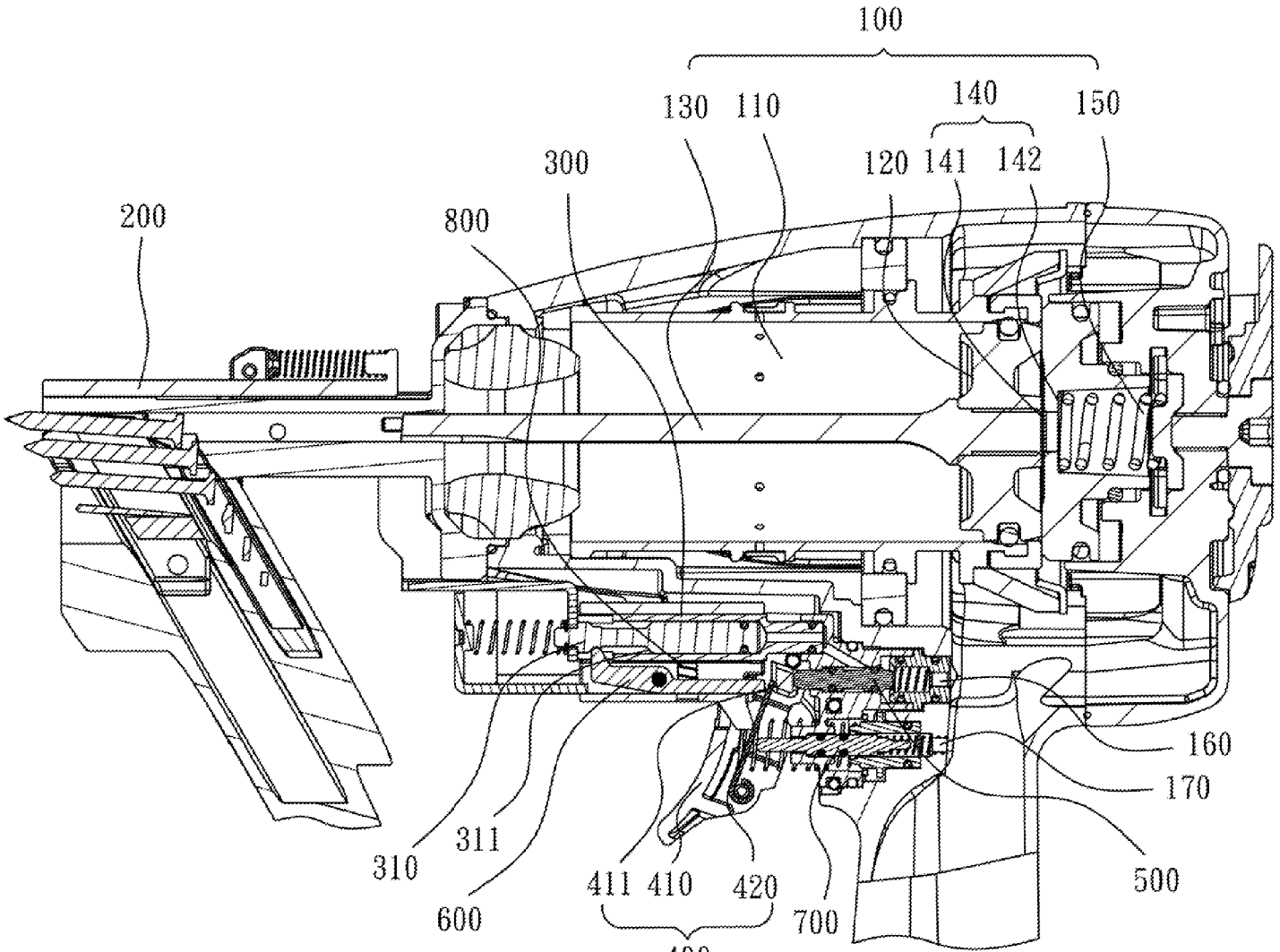
FIG. 1 is a longitudinal section view of a nail gun according to one embodiment of the present disclosure.

FIG. 1 is a longitudinal section view of a nail gun according to one embodiment of the present disclosure. The pneumatic nail gun includes a gun body 100, a connecting mechanism

200, an acting valve 300, a trigger 400, a safety valve 500, and a trigger valve 700. The gun body 100 includes a safety compressed air inlet 160 and a firing compressed air inlet 170. The connecting mechanism 200 is slidably disposed on the gun body 100. The acting valve 300 is connected to the connecting mechanism 200. The trigger 400 is connected to the gun body 100. The safety valve 500 is connected to the acting valve 300.

Figure 2:
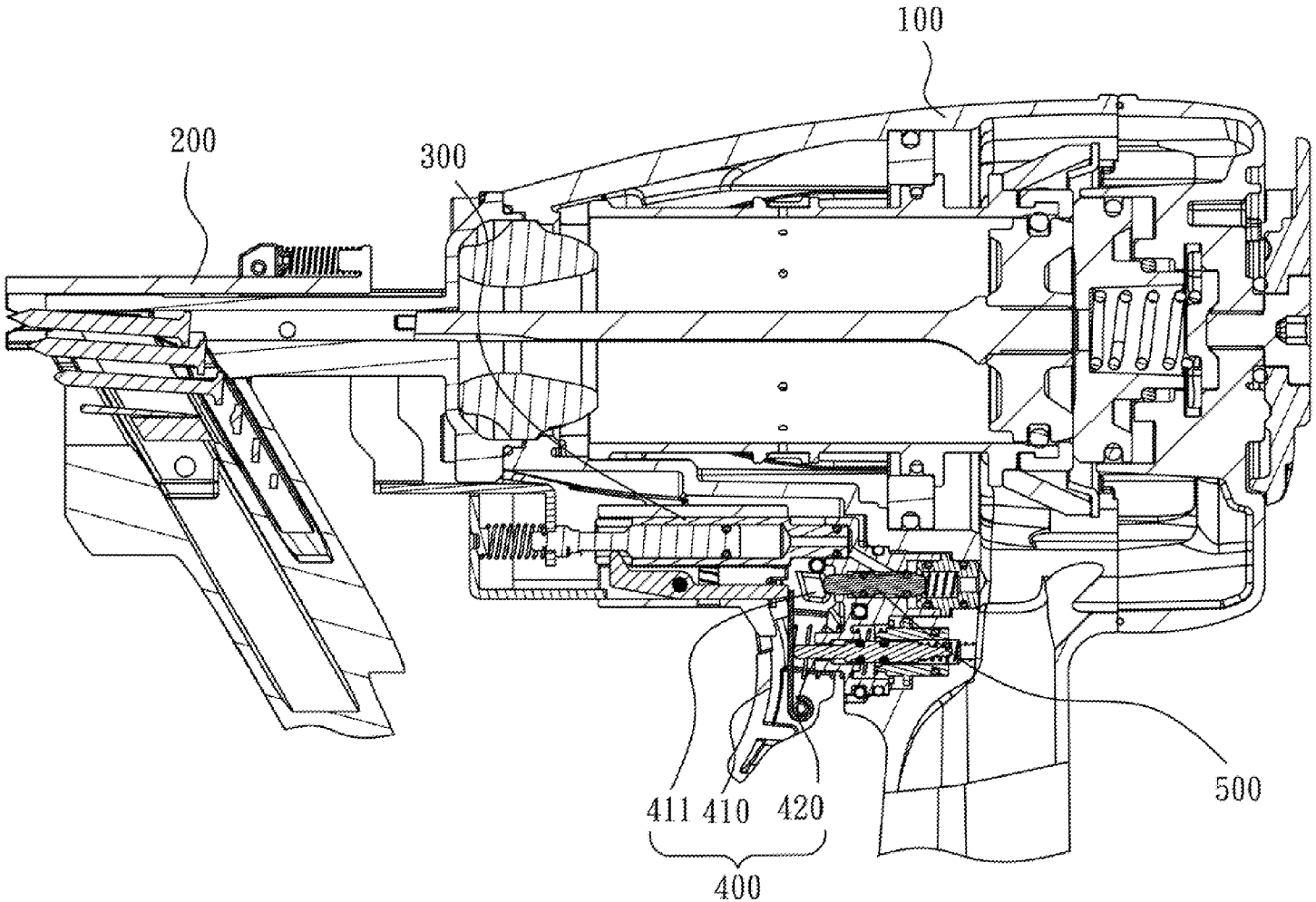
FIG. 2 is a longitudinal section view of the nail gun of FIG. 1, showing that a trigger of the nail gun is pulled.

FIG. 2 is a longitudinal section view of the nail gun of FIG. 1, showing that the trigger 400 is pulled. In use, the safety compressed air inlet 160 and the firing compressed air inlet 170 connects to a compressed air source (not shown) respectively. Then, the user pulls trigger 400. The trigger 400 opens the safety valve 500. The safety valve 500 allows a safety compressed air coming from the compressed air source to drive the acting valve 300 to move the connecting mechanism 200 forwards.

More particularly, the trigger 400 includes a trigger body 410 and a swing arm 420. The trigger body 410 is connected to the gun body 100. The trigger body 410 has a protrusion 411. The swing arm 420 is pivotally connected to the trigger body 410. The protrusion 411 of the trigger body 410 opens the safety valve 500 to move the connecting mechanism 200 forwards when the trigger 400 is pulled.

Furthermore, the acting valve 300 is a piston valve. The acting valve 300 has a piston 320. The piston 320 is connected to the connecting mechanism 200. The piston 320 and the connecting mechanism 200 move forward together when the safety compressed air pushes the piston 320.

Figure 3:
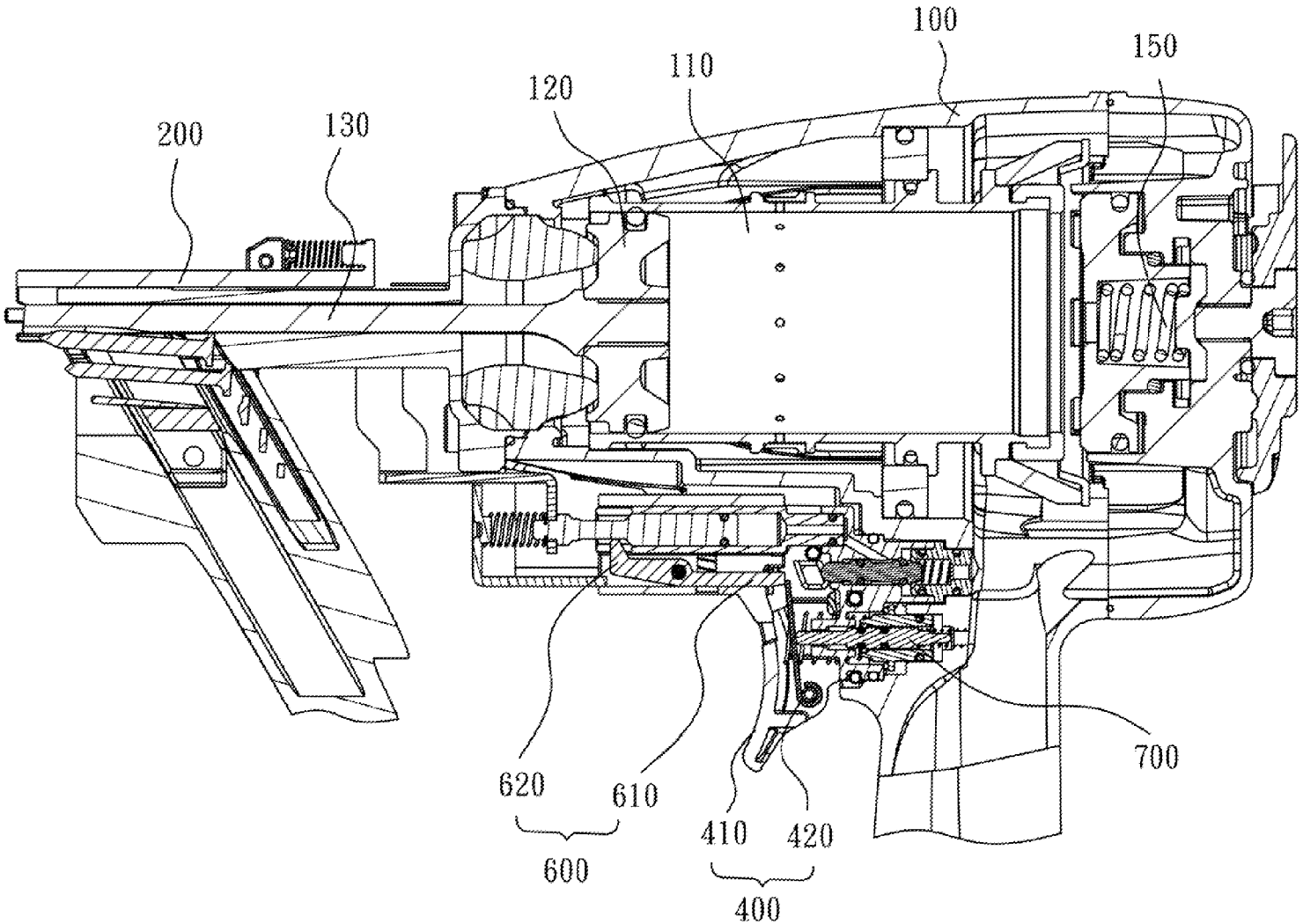
FIG. 3 is a longitudinal section view of the nail gun of FIG. 1, showing that the nail gun projects a nail.

FIG. 3 is a longitudinal section view of the nail gun of FIG. 2, showing that the nail gun projects a nail. The connecting mechanism 200 is stopped to move forwards when the connecting mechanism 200 contacts a workpiece (not shown) which blocks the connecting mechanism 200. The swing arm 420 opens the trigger valve 700. Then, the trigger valve 700 releases a firing compressed air coming from the compressed air source to project at least one nail.

In detail, the nail gun further includes a lever 600. The lever 600 is pivotally connected to the gun body 100. The lever 600 has a first end 610 and a second end 620. The first end 610 touches the swing arm 420 to restrain the swing arm 420 from rotating relative to the trigger body 410. The second end 620 touches the acting valve 300. The swing arm 420 can open the trigger valve 700 when the trigger 400 is pulled and the first end 610 supports the swing arm 420.

Return to FIG. 1. More particularly, the gun body 100 includes a cylinder 110, a projecting piston 120, a firing pin 130, a cover 140, a cover spring 150, and an opening compressed air inlet (not shown). The projecting piston 120 fits and travels in the cylinder 110. The firing pin 130 is fixed to the projecting piston 120. The cover 140 includes a front side 141 and a back side 142. The cover spring 150 connects the back side 142 of the cover 140 and the gun body 100. The cover spring 150 pushes the front side 141 of the cover 140 to seal the cylinder 110. The back side 142 connects to the trigger valve 700. The firing compressed air is between the cover 140 and the trigger valve 700. The firing compressed air pushes the cover 140 to seal the cylinder 110.

The opening compressed air inlet connects to the compressed air source. An opening compressed air coming from the compressed air source pushes the front side 141 of the cover 140 for opening the cylinder 110. The total force of the firing compressed air and the cover spring 150 is larger than the opening compressed air.

With references to FIG. 3, the firing compressed air flows out from the trigger valve 700 when the swing arm 420 opens the trigger valve 700. Until the force of the opening compressed air is larger than the total force of the firing compressed air and the cover spring 150, the cylinder 110 is opened. Thus, the opening compressed air flows into the cylinder 110 and pushes the projecting piston 120 and the firing pin 130 to move forward. Then, the firing pin 130 strikes and projects the nail.

Figure 4:
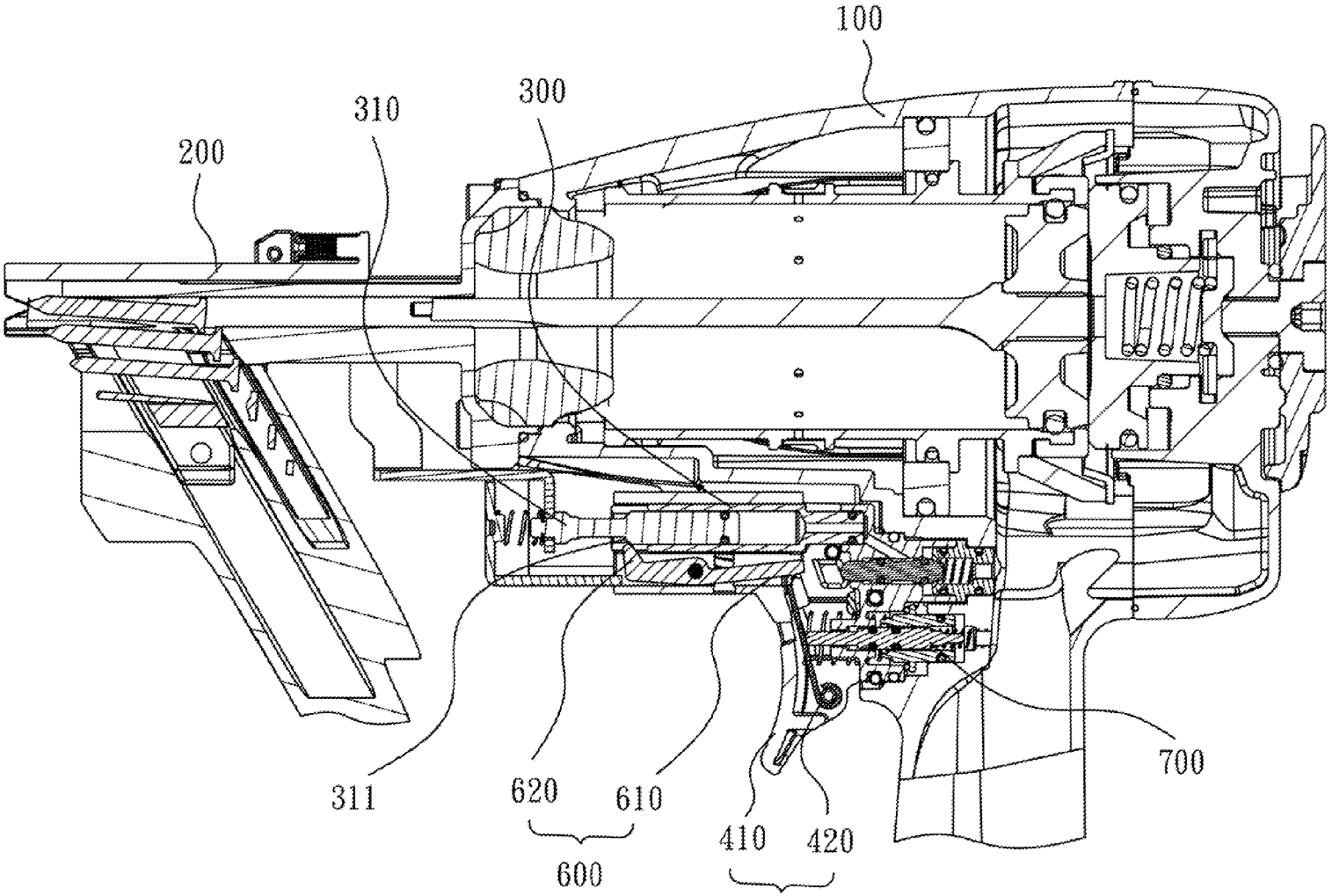
FIG. 4 is a longitudinal section view of the nail gun of FIG. 1, showing that a lever of the nail gun leaves the trigger.

FIG. 4 is a longitudinal section view of the nail gun of FIG. 1, showing that the lever 600 leaves the trigger 400. The connecting mechanism 200 moves to the end of the gun body 100 when the workpiece does not block the connecting mechanism 200. The acting valve 300 drives the lever 600 to leave the swing arm 420, and the lever 600 can not support the swing arm 420 to open the trigger valve 700. Therefore, the nail gun can not be fired.

In detail, the piston 310 of the acting valve 300 has a protrusion 311. The protrusion 311 pushes the second end 620 of the lever 600 to rotate the lever 600. Then, the first end 610 of the lever 600 leaves the swing arm 420, and the nail gun can not be fired. The term "the end of the gun body 100" means a position that the connecting mechanism 200 can not move forward anymore on the gun body 100.

Return to FIG. 1, the nail gun further includes a spring 800, and the spring 800 connects the lever 600 and the gun body 100. The lever 600 compresses the spring 800 when the protrusion 320 pushes the lever 600 to rotate. The spring 800 extends and restores the lever 600 when the protrusion 320 leaves the lever 600.

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise; each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, 6th paragraph. In particular, the use of "step of" in the claims is not intended to invoke the provisions of 35 U.S.C. §112, 6th paragraph.

What is claimed is:

1. A pneumatic nail gun comprising:

a gun body including a safety compressed air inlet and a firing compressed air inlet for connecting to a compressed air source respectively;

a connecting mechanism slidably disposed on the gun body;

an acting valve connected to the connecting mechanism;

a trigger connected to the gun body;

a safety valve connected to the acting valve for allowing a safety compressed air coming from the compressed air source to drive the acting valve to move the connecting mechanism forwards when the trigger is pulled;

a trigger valve for releasing a firing compressed air coming from the compressed air source to project at least one nail only when the trigger is pulled, a workpiece blocks the connecting mechanism, and the trigger opens the trigger valve.

2. The pneumatic nail gun of claim 1, further comprising a lever pivotally connected to the gun body, and the lever having a first end touching the trigger and a second end touching the acting valve.

3. The pneumatic nail gun of claim 2, wherein the acting valve includes a piston, the piston has a protrusion for pushing the second end of the lever to make the first end of the lever leaves the trigger.

4. The pneumatic nail gun of claim 2, further comprising:

a spring connecting the lever and the gun body.

5. The pneumatic nail gun of claim 2, wherein the trigger comprises:

a trigger body connected to the gun body; and a swing arm pivotally connected to the trigger body, wherein the first end of the lever touches the swing arm for restraining the swing arm from rotating relative to the trigger body.

* * * * *